US005711526A

United States Patent [19]

Van Hollebeke

[11] Patent Number: 5,711,526

[45] Date of Patent: Jan. 27, 1998

[54] CARD GAME PLAYING METHOD

[76] Inventor: Ron Van Hollebeke, 3226 Rocky Point Dr., Bremerton, Wash. 98312

[21] Appl. No.: 536,285

[22] Filed: Sep. 29, 1995

[51] Int. Cl.[6] ..... A63F 1/00

[52] U.S. Cl. ..... 273/303

[58] Field of Search ..... 273/292, 303

[56] References Cited

PUBLICATIONS

The Complete Book of Games by Clement Wood and Gloria Goddard, 1940 pp. 216–219, 220–221, 223a–223d.

Encyclopedia of Games by John Scarne, 1964 pp. 74–75, 6–10, 54–56, 75–76.

*Primary Examiner*—Benjamin H. Layno
*Assistant Examiner*—Stephen Blau
*Attorney, Agent, or Firm*—Kilpatrick Stockton LLP

[57] ABSTRACT

A method of playing a card game is disclosed which includes the steps of dealing a first set of player hands, determining a wild card from a predetermined list, allowing each player in turn to attempt to lay down a matched set or sequence of cards, calculating a respective point count total for each of the players with cards left in their hand after one of the players lays down all of their cards during a particular hand, dealing a subsequent set of player hands, changing the wild card determination to a proceeding card type in the list upon each subsequent dealing of player hands, and determining a total point count number for each player after the thirteenth hand by summing their individual point count totals for each of the thirteen hands. The winner is declared as being the player with the lowest total point count number.

5 Claims, 1 Drawing Sheet

| WILD CARD | | DIPLOMATIC IMMUNITY | | | | | | |
|---|---|---|---|---|---|---|---|---|
| | | | SCORE | SCORE | SCORE | SCORE | SCORE | DEALER |
| A | | | | | | | | |
| 2 | / | | | | | | | |
| 3 | / | | | | | | | |
| 4 | / | | | | | | | |
| 5 | / | | | | | | | |
| 6 | / | | | | | | | |
| 7 | / | | | | | | | |
| 8 | / | | | | | | | |
| 9 | / | | | | | | | |
| 10 | / | | | | | | | |
| J | / | | | | | | | |
| Q | / | | | | | | | |
| K | / | | | | | | | |

CARD GAME PLAYING METHOD

FIELD OF THE INVENTION

The present invention relates to games, and, more particularly, to a novel card game which may be played by two to five people for both amusement and mental stimulation.

BACKGROUND OF THE INVENTION

The playing of card games has been a common form of amusement, recreation and mental stimulation used by people around the world for many years. Few other diversions exist which are as inexpensive and yet as mind-stimulating as card games.

Common card games include poker, hearts, bridge and rummy. A rummy-type card game is one where each of the players aim to form in their hand matched sets of 3 or more of a kind (i.e., 9 club, 9 diamond, 9 spade) or sequences of 3 or more cards of the same suit (i.e., Jack, 10, 9 of diamond).

A typical card game involves two or more players where each plays for himself. A dealer distributes a plurality of cards to each of the players. Upon receipt of their "hand", each player examines their cards and attempts to form the best possible hand by combining individual cards into separate groups according to a predetermined hierarchy. Some card games allow players to form a better hand by discarding particular cards and receiving new cards from a stock pile.

Card games often include the designation of one or more cards as "wild" cards. A player with a "wild" card in their possession may chose one of a predetermined number of values for that card. Very often, the "wild" card may only be used in the particular hand in which it is received.

SUMMARY OF THE INVENTION

The card game of this invention is identified as "Political Rummy" and refers to such terms as "diplomatic immunity", "entitlement" and "pork barrel", each of which will be described hereinafter. The game can be played by two to five individual players, where each plays for himself. A standard pack of fifty-two cards is used.

Each player attempts to form in their hand matched sets consisting of three or more of a kind (as a 9, 9 and a 9), or sequences of three or more cards of the same suit (as a Jack, 10, 9). A player can use the wild card in either the matched sets or sequences to complete a set. If a player has played a wild card in a set of two 9 cards and a wild card, the player who has another 9 card in their hand can pick up the wild card and replace it with the 9 card from their hand when their turn comes up. This wild card then becomes whatever that player wants it to be to complete a set or sequence. The player has the option to hold or play the wild card when they pick it up.

A player cannot play on another player's laid down cards until that player lays down on the table, face up, a matched set or sequence with or without a wild card. When a player gets rid of all of his cards in this manner, he wins that hand of the game. This is referred to as "going out". If a player does this on his first hand he receives a "diplomatic immunity", enabling him to not have to count the total score left in his hand in any single subsequent hand except the last hand. That player must have all seven cards in hand at the time that they claim "diplomatic immunity".

When a player's hand puts him 50 points behind the other players, that player can determine the wild card for that hand. If a player's hand puts him 100 points behind, that player can name two wild cards for that hand.

Each face card is worth 10 points, Aces are worth 1 point each, a wild card still in the hand is worth 25 points, while the other cards are worth their pip value. The game ends after the thirteenth hand. The object of the game is to have a lower point count total than the other players at the game's end and thus win the game.

DETAILED DESCRIPTION OF THE PREFERRED EMBODIMENT(S)

Figure 1:
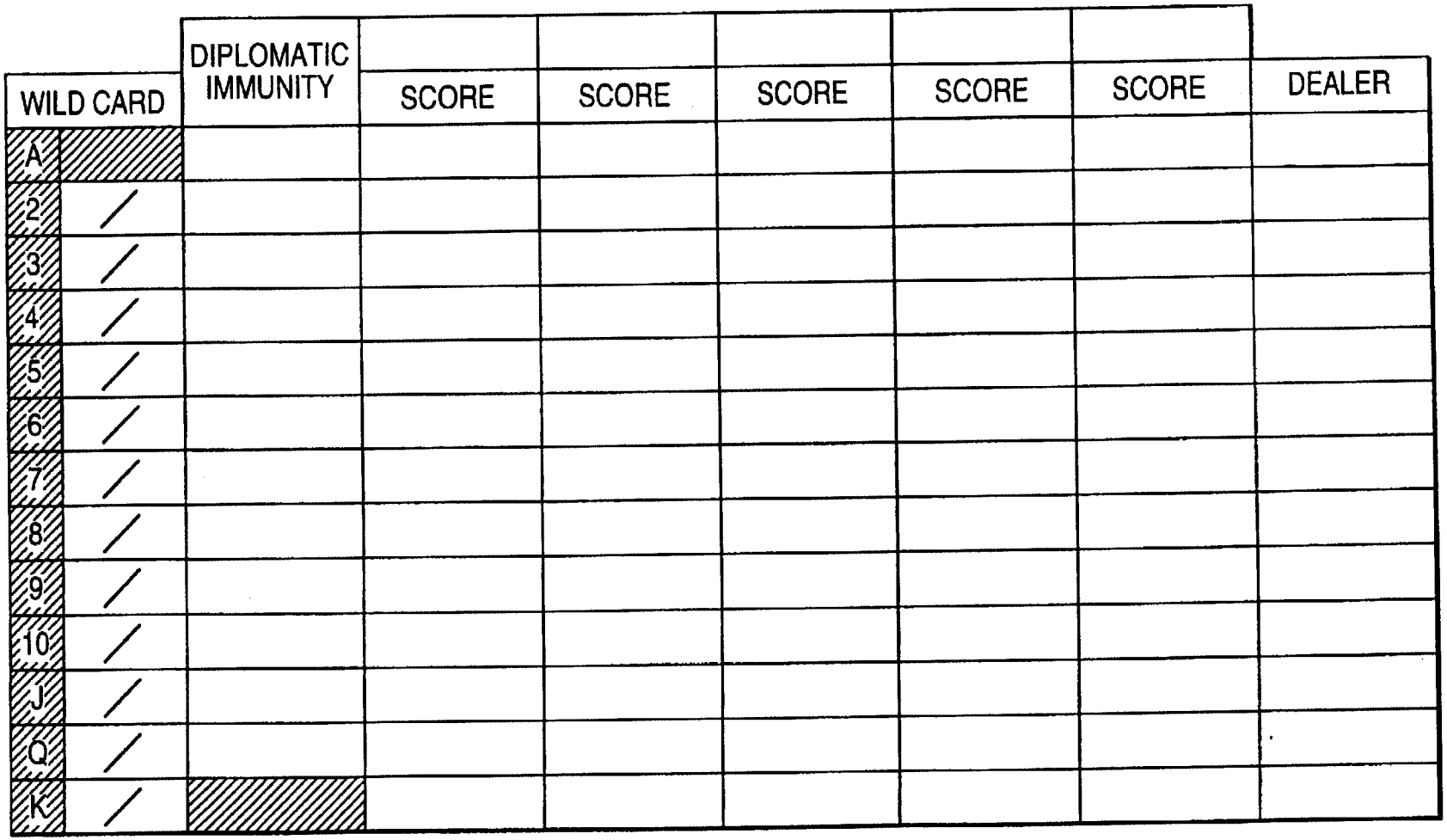
FIG. 1 is a score sheet for the Political Rummy game showing score columns as well as indications of wild card, diplomatic immunity and the dealer.

With reference to FIG. 1, the method of playing a preferred embodiment of the card game of the present invention will now be described. The game is designed for two to five players using a conventional fifty-two card deck of playing cards. The cards are preferably reshuffled and cut after every hand. The dealer at the beginning of the game may be determined by drawing or cutting the deck of cards. After each hand, the player with the highest score on the last hand is the designated dealer for the next hand.

The dealer gives one card at a time, face down to each player in rotation to the left, until each player has seven cards and the dealer has eight cards. The remaining cards are placed face down in the center of the table, forming the stock.

The Ace's are the wild card for the first hand. Deuce's are wild for the second hand and so on thorough the entire deck up to the King's. Each card is wild in sequence for 13 hands except when a player becomes 50 or 100 points behind, as will be described in the following description. The game ends after the thirteenth hand.

Each player will examine the cards forming their hand and attempt to form matched sets consisting of three or more of a kind (i.e., 9 of clubs, 9 of diamonds and 9 of spades) or sequences of 3 or more cards of the same suit (i.e., Jack of diamond, 10 of diamond and 9 of diamond). A player can use the wild card in either the matched sets or sequences. This is desirable because in determining the point count value of a player's hand, any set of three or more of a kind and any suited three or more card run count as zero; and at the games end, the player having the lowest point count total is the winner.

In starting the game, the dealer can lay down the plays in his hand or just discard to start the discard pile. The rotation of players continues in a clockwise rotation.

Each player in turn draws from the stock pile, plays and discards. Each player also has the choice of using the top card of the discard pile but they must play that card immediately during their turn. If the player has played a wild card in a set (such as two 9's a wild card), the player who has another 9 in their hand can pick up the wild card and replace it with a 9 from their hand when their turn comes up. This wild card then becomes whatever the player wants it to be to complete a set or sequence. The player has the option to hold or play the wild card when they pick it up. Although the "9" card kind has been used in the foregoing example, this procedure applies analogously to any other card kind in the standard fifty-two card deck.

When a player lays down two wild cards and another card and does not indicate what the two wild cards will be, i.e., 3 and two wild cards, a 3, 4, 5 of hearts or three 3's, any of the other players can designate what the two wild cards will be for the remainder of the hand.

A player cannot play on another player's laid down cards until the player lays down on the table, face up, a meld. This is any matched set or sequence with or without a wild card. This feature of the game is referred to as "laying off".

When a player gets rid of all of their cards in this manner, they win that hand of the game. This is referred to as "going out". Once a player "goes out", ie. lays down all of their cards in a hand, that hand comes to a close and a point count for each of the other players is calculated. The point count calculation is determined by assigning a point value from the "Point Value of Cards" table for each remaining card in each player's hand. The point values for all of each player's respective remaining cards at the end of the hand are summed up to determine each player's respective point count total for that particular hand. These point count totals can be recorded on the score sheet presented in FIG. 1. As seen in the "Point Value of Cards" table, each face card is worth 10 points, Aces are worth 1 point each, a wild card still in the hand is worth 25 points, while the other cards are worth their pip value. The player does not need a discard to win a particular hand.

If a player "goes out" on their first hand, they received what is referred to as "diplomatic immunity". This enables them to not have to count the total score left in their hand in any particular later hand except for the last hand. The player must have all seven cards in hand when diplomatic immunity is asserted.

As stated above, the "wild" card at the beginning of the game is the Ace. The "wild" card for the second hand is the deuce. This sequence continues for 13 hands up to the King for each respective hand. This sequence may be broken when a player becomes 50 or 100 points behind.

When a player gets 50 points behind the other players, they may determine the wild card for that hand. This is referred to as "Entitlement" i.e. welfare.

When a player gets 100 points behind the other players, they may name two wild cards for that hand. This is referred to as "Pork Barrel".

When "Entitlement" or "Pork Barrel" is implemented by a player, the normal wild card in sequence for that hand is replaced by whatever the implementer chooses as a single wild card in "Entitlement" or a pair of wild cards in "Pork Barrel". On moving to the next hand in the game, the next sequential wild card is applied as under normal circumstances.

In determining scoring totals, the cards have point values as set forth in the following table.

TABLE

Point Value of Cards

| Card | Point Value |
|---|---|
| Ace (any suit) | 1 |
| deuce (any suit) | 2 |
| 3 (any suit) | 3 |
| 4 (any suit) | 4 |
| 5 (any suit) | 5 |
| 6 (any suit) | 6 |
| 7 (any suit) | 7 |
| 8 (any suit) | 8 |
| 9 (any suit) | 9 |
| 10 (any suit) | 10 |

TABLE-continued

Point Value of Cards

| Card | Point Value |
|---|---|
| Jack (any suit) | 10 |
| Queen (any suit) | 10 |
| King (any suit) | 10 |
| Wild Card in Hand | 25 |

The game ends after the thirteenth hand. At that point, a total point count number is determined for each player by summing their point count totals for each of the hands. The player with the lowest total point count number at the end of the game is declared the winner.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A method of playing a card game, comprising the steps of:

dealing from a single standard deck of 52 playing cards with no jokers used a first set of two to five player hands, one hand to each player respectively, each hand consisting of seven cards to each player and one hand of eight cards to the dealer;

determining a wild card as being the first card type listed in a predetermined sequential list of card types;

allowing each player in turn beginning with the dealer playing first to attempt to lay down a matched set or sequence of cards from their hand or discard a single card face up in a discard pile;

allowing a player whose turn is up, at their option, to pick up and immediately play a card from the discard pile;

allowing a player whose turn is up, at their option, to pick up a wild card and replace it with a non-wild card after a preceding player has laid down that wild card with a plurality of other cards corresponding in point value to said non-wild card and where the player whose turn is up has the option to hold or play the wild card after they pick it up;

calculating a respective point count total for each of the players with cards left in their hand after one of the players lays down all of their cards face up in matched sets or sequences during a particular hand;

dealing a subsequent set of player hands to each of said players after said calculating step;

changing the wild card determination to a proceeding card type in said sequential list upon each respective subsequent dealing of player hands to each of said players;

replacing the wild card determination of said changing step with a player's choice of the wild card for a particular hand dealing when that player is at least 50 points and less than 100 points behind the other players in the game; and declaring a winner as being the player with the lowest total point count number;

wherein each player's respective point count total for any particular hand is calculated by assigning a predetermined point value to each remaining card in each player's hand and summing the point values for all of each player's respective remaining cards in that hand.

2. The method of claim 1, wherein said sequential list of card types is Ace, deuce, 3, 4, 5, 6, 7, 8, 9, 10, Jack, Queen, King.

3. A method of playing a card game, comprising the steps of:

dealing from a single standard deck of 52 playing cards with no jokers used a first set of two to five player hands, one hand to each player respectively, each hand consisting of seven cards to each player and one hand of eight cards to the dealer;

determining a wild card as being the first card type listed in a predetermined sequential list of card types;

allowing each player in turn beginning with the dealer playing first to attempt to lay down a matched set or sequence of cards from their hand or discard a single card face up in a discard pile;

allowing a player whose turn is up, at their option, to pick up and immediately play a card from the discard pile;

allowing a player whose turn is up, at their option, to pick up a wild card and replace it with a non-wild card after a preceding player has laid down that wild card with a plurality of other cards corresponding in point value to said non-wild card and where the player whose turn is up has the option to hold or play the wild card after they pick it up;

calculating a respective point count total for each of the players with cards left in their hand after one of the players lays down all of their cards face up in matched sets or sequences during a particular hand;

dealing a subsequent set of player hands to each of said players after said calculating step;

changing the wild card determination to a proceeding card type in said sequential list upon each respective subsequent dealing of player hands to each of said players;

replacing the wild card determination of said changing step with a player's choice of two wild cards for a particular hand dealing when that player is at least 100 points behind the other players in the game; and declaring a winner as being the player with the lowest total point count number;

wherein each player's respective point count total for any particular hand is calculated by assigning a predetermined point value to each remaining card in each player's hand and summing the point values for all of each player's respective remaining cards in that hand.

4. The method of claim 3, wherein said sequential list of card types is Ace, deuce, 3, 4, 5, 6, 7, 8, 9, 10, Jack, Queen, King.

5. A method of playing a card game, comprising the steps of:

dealing from a single standard deck of 52 playing cards with no jokers used a first set of two to five player hands, one hand to each player respectively, each hand consisting of seven cards to each player and one hand of eight cards to the dealer;

determining a wild card as being the first card type listed in a predetermined sequential list of card types;

allowing each player in turn beginning with the dealer playing first to attempt to lay down a matched set or sequence of cards from their hand or discard a single card face up in a discard pile;

allowing a player whose turn is up, at their option, to pick up and immediately play a card from the discard pile;

allowing a player whose turn is up, at their option, to pick up a wild card and replace it with a non-wild card after a preceding player has laid down that wild card with a plurality of other cards corresponding in point valise to said non-wild card and where the player whose turn is up has the option to hold or play the wild card after they pick it up;

wherein when a player lays down two wild cards and a non-wild card and does not indicate what the two wild cards will be, any of the other players can designate what the two wild cards will be for the remainder of the hand;

calculating a respective point count total for each of the players with cards left in their hand after one of the players lays down all of their cards face up in matched sets or sequences during a particular hand;

dealing a subsequent set of player hands to each of said players after said calculating step;

changing the wild card determination to a proceeding card type in said sequential list upon each respective subsequent dealing of player hands to each of said players; and declaring a winner as being the player with the lowest total point count number;

wherein each player's respective point count total for any particular hand is calculated by assigning a predetermined point value to each remaining card in each player's hand and summing the point values for all of each player's respective remaining cards in that hand.

* * * * *